United States Patent [19]

Vaughan et al.

[11] Patent Number: 4,793,319

[45] Date of Patent: Dec. 27, 1988

[54] ARCHERY BOW LIMB ADJUSTMENT BOLT

[76] Inventors: Norman Vaughan, 424 Monroe St., Delta, Ohio 43515; James A. Nuhfer, 30 S. Dorcase, #16, Toledo, Ohio 43615

[21] Appl. No.: 25,221

[22] Filed: Mar. 12, 1987

[51] Int. Cl.[4] ..... F41B 5/00; F16B 23/00

[52] U.S. Cl. ..... 124/23 R; 124/DIG. 1; 124/89; 411/396; 411/397

[58] Field of Search ..... 124/23 R, 24 R, 86; 411/396, 397, 403, 398, 395

[56] References Cited

U.S. PATENT DOCUMENTS

| | | | |
|---|---|---|---|
| 209,233 | 10/1878 | Cox | 411/409 |
| 375,206 | 12/1887 | Shelton | 411/403 |
| 1,327,587 | 1/1920 | Bliss | 411/403 |
| 1,486,719 | 3/1924 | Aldrich | 411/409 |
| 1,609,645 | 12/1926 | Dewire | 411/396 |
| 1,683,501 | 9/1928 | Tobeler | 411/403 |
| 2,013,578 | 9/1935 | Padieck | 411/397 |
| 2,213,630 | 9/1940 | Gade | 411/396 |
| 2,333,986 | 11/1943 | Crayton | 403/311 |
| 2,764,886 | 10/1956 | Wiesman | 411/403 |
| 2,931,265 | 4/1960 | De Lacy | 411/403 |
| 3,176,359 | 4/1965 | Ward | 411/396 |
| 3,440,922 | 4/1969 | Cohen | 411/397 |
| 3,461,769 | 8/1969 | Brosseit | 411/395 |
| 3,486,495 | 12/1969 | Allen | 124/DIG. 1 |
| 3,814,075 | 6/1974 | Hoyt, Jr. | 124/24 R |
| 4,178,905 | 12/1979 | Groner | 124/23 R |

FOREIGN PATENT DOCUMENTS

| | | | |
|---|---|---|---|
| 606122 | 3/1926 | France | 411/396 |
| 674020 | 10/1929 | France | 411/397 |
| 554901 | 1/1957 | Italy | 411/356 |
| 25965 | 2/1977 | Japan | 411/396 |
| 678839 | 9/1952 | United Kingdom | 411/396 |

*Primary Examiner*—Richard C. Pinkham
*Assistant Examiner*—Gary Jackson
*Attorney, Agent, or Firm*—Marshall & Melhorn

[57] ABSTRACT

A limb adjustment bolt for a compound archery bow includes a threaded shank for releasably attaching a limb to a handle portion of the bow. One end of the shank is connected to a generally circular flange which in turn is attached to a head of the bolt. The head is generally rectangular in cross section and has a longitudinal axis which is perpendicular to the longitudinal axis of the shank. A central portion of the head tapers outwardly and is attached to the flange. The head can include a threaded aperture for receiving a couterweight. Furthermore, the bolt can be formed of a separate head and shank.

19 Claims, 2 Drawing Sheets

ARCHERY BOW LIMB ADJUSTMENT BOLT

BACKGROUND OF THE INVENTION

The invention relates to archery bows, in general, and in particular to an adjustment bolt for attaching a bow limb to a handle member of a compound bow.

In a standard bow, the force with which the arrow is dispatched is dependent upon the resilience of the limbs of the bow. An archer's bow will have a pound rating varying from about fifteen to one hundred pounds. When the rating gets above about thirty-five pounds, it requires a rather strong person to pull the bow back to the release position and to hold the position as the arrow is aimed prior to release.

In a compound bow construction, the pull on the bow string is high at the beginning of the draw, but the human arm at this point is able to exert a maximum force. As the draw progresses a little beyond mid-point, there is an over center action on eccentric pulleys which decreases the draw force needed to maintain the bow string in a drawn position without decreasing the energy stored in the limbs of the bow. Thus, at full draw, it is relatively easy to hold the bow and the bow string and much easier to perfect the aiming technique and the proper finger release.

The bow limbs are typically attached to the handle member by adjustment bolts. Rotation of the adjustment bolts provides a range of angular relationships between the bow limbs and the handle with corresponding differences in the amount of force imparted to the arrow for a given pull distance on the draw string. In the prior art, the heads of these adjustment bolts have been provided with a hexagonal aperture. Thus, an Allen wrench must utilized to rotate the bolts to either change the force of the bow or to disassemble the bow for travel. It is relatively inconvenient to locate the proper Allen wrench each time it is needed and there is always the chance that the Allen wrench can be lost at a time when it is most needed.

SUMMARY OF THE INVENTION

The present invention involves a bow limb adjustment bolt having a head of a size and shape whereby it is capable of being grasped between the thumb and forefinger of a human hand to enable force adjustments and ease of disassembly of the bow. The head is of generally rectangular cross section with a longitudinal axis perpendicular to the longitudinal axis of the shank of the bolt. The center of the head tapers outwardly into a flange at the connection to the head. The bolt head can have a threaded aperture formed in its top surface for accepting a threaded end of a balancing weight device. The adjustment bolt also can be a single piece unit or be constructed of a separate head and shank. Furthermore, the flange can have indicia formed thereon for indicating the desired amount of rotation for changing the force on the drawstring.

BRIEF DESCRIPTION OF THE DRAWINGS

The above, as well as other advantages of the present invention, will become readily apparent to those skilled in the art from the following detailed description of preferred embodiments when considered in the light of the accompanying drawings in which.

DESCRIPTION OF THE PREFERRED EMBODIMENTS

Figure 1:
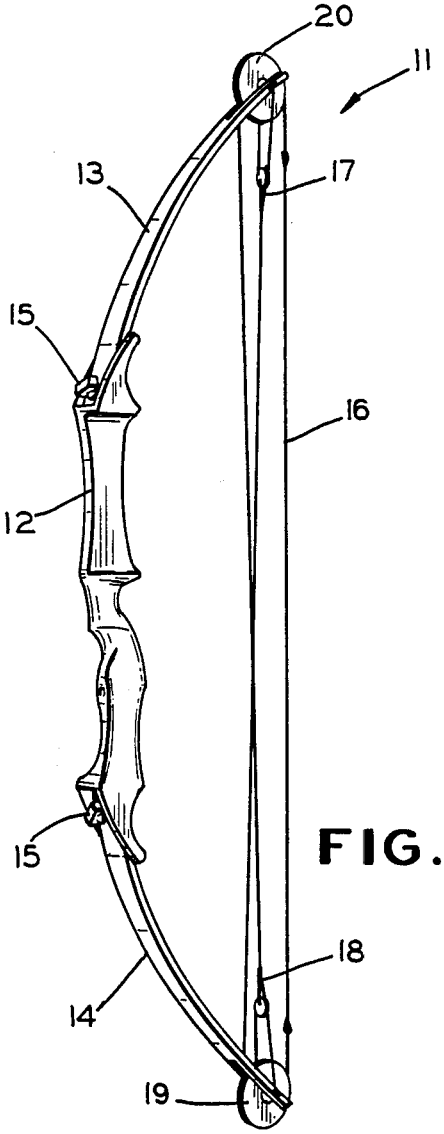
FIG. 1 is a side elevational view of a compound archery bow embodying the features of the present invention.
Figure 2:
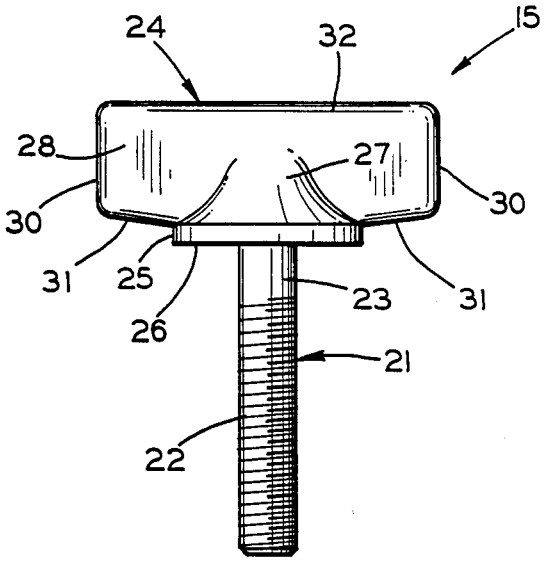
FIG. 2 is a front elevational view of a bow limb adjustment bolt in accordance with the present invention.
Figure 3:
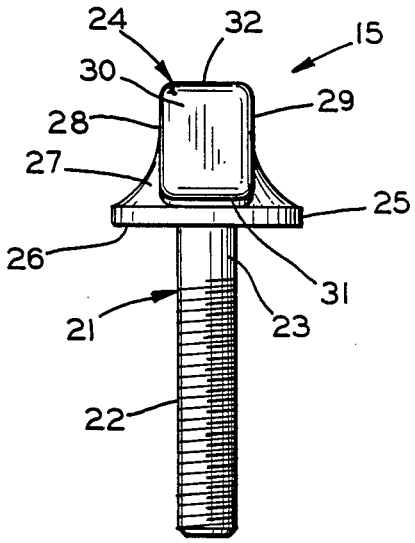
FIG. 3 is a side elevational view of the bolt shown in FIG. 2.
Figure 4:
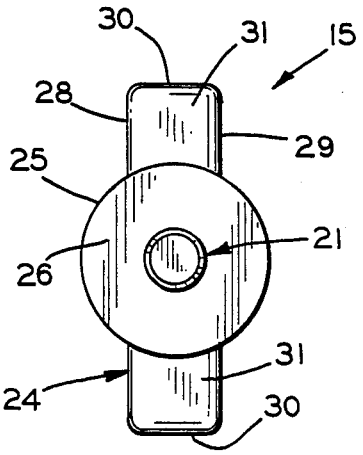
FIG. 4 is a bottom plan view of the bolt shown in FIG. 2.
Figure 5:
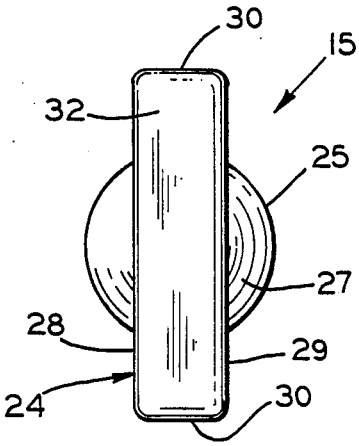
FIG. 5 is a top plan view of the bolt shown in FIG. 2.

There is shown in FIG. 1 a compound bow 11 including a central handle portion 12 having an upper limb 13 and a lower limb 14 releasably attached thereto. A pair of limb adjustment bolts 15 according to the present invention are threaded through the inner ends of the limbs 13 and 14 and threadably engage the end portions of the handle 12. Rotating the adjustment bolts to move them inwardly or outwardly relative to the handle 12 causes the corresponding limb to pivot about an attachment point thereby changing the angle of the limb relative to the handle and changing the force required to pull a drawstring 16 a predetermined distance from the handle 12. Opposite ends 17 and 18 of the drawstring 16 are attached to the outer ends of the upper limb 13 and lower limb 14 respectively. The drawstring extends from the end 17 around a cam 19 rotatably mounted at the outer end of the lower limb 14. The other end 18 of the drawstring 16 is attached to the outer end of the lower limb 14 and extends around a cam 20 rotatably mounted at the outer end of the upper limb 13. With the exception of the adjustment bolts 15, the aforementioned compound bow is of conventional construction and operates in a known manner.

The adjustment bolt 15 according to the present invention is shown in FIGS. 2 through 5. The bolt 15 includes a shank 21 having threads 22 formed thereon from a lower end to an upper end portion 23 which is unthreaded. The upper end of the end portion 23 is attached to a head 24 of the bolt 15. The head 24 has a lower flange portion 25 with a relatively planar lower surface 26 to which the upper end portion 23 of the shank 21 is attached. A central portion 27 of the head 24 tapers downwardly and outwardly from a substantially vertically extending pair of front and back walls 28 and 29 of a handle portion of the head 24. The handle portion of the head 24 is generally rectangular in cross section and has a longitudinal axis which extends generally perpendicular to the longitudinal axis of the shank 21. The front wall 28 and rear wall 29 are joined by a pair of end walls 30, a bottom wall 31, and a top wall 32. The junctions of all of the walls are rounded to eliminate any sharp corners. Furthermore, the bottom wall 31 is tapered from the end walls 30 downwardly to the flange 25.

Although the bolt 15 according to the present invention can be made in various sizes, the following dimensions have been found suitable for most compound bows commercially available. The distance between the end walls 30 is approximately two and one quarter inches. The distance between the front wall 28 and the rear wall 29 is approximately five-eights of an inch and the distance between the bottom wall 31 and the top wall 32 at the end walls 30 is approximately three quarters of an inch. The distance between the lower planar surface 26 and the top wall 32 is approximately seven eights of an inch. The flange 25 is approximately one and one quarter inches in diameter and the shank 21 is approximately two inches in length. The threads 22 can be five sixteenths inch in diameter with eighteen threads to the inch.

Figure 6:
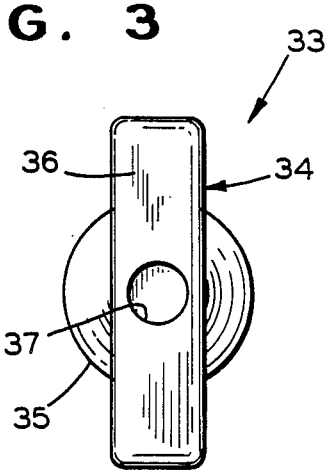
FIG. 6 is a top plan view of an alternate embodiment of the bolt shown in FIG. 2.
Figure 10:
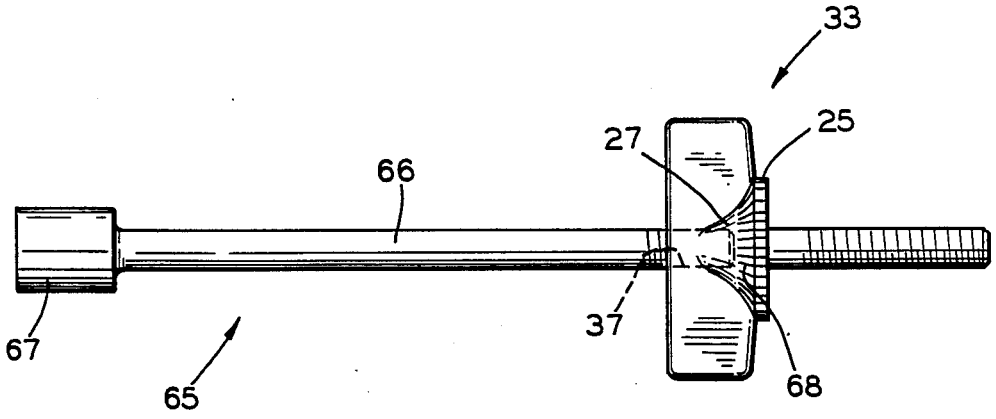
FIG. 10 is a front elevational view of the bolt shown in FIG. 6 attached to a stabilizer.

There is shown in FIG. 6 a top plan view of an alternate embodiment of the adjustment bolt according to the present invention. An adjustment bolt 33 has a head 34 including a flange 35 and a top wall 36. A threaded aperture 37 is formed in the head 34 with an opening in the top wall 36. The longitudinal axis of the threaded aperture 37 is the same as the longitudinal axis of the shank portion (not shown) of the bolt 33. The shank portion is similar to the shank portion of the bolt 15. The threaded aperture 37 is typically one quarter inch in diameter with twenty threads to the inch. The threaded aperture 37 accepts most commercially available stabilizers such as shown in FIG. 10.

Figure 7:
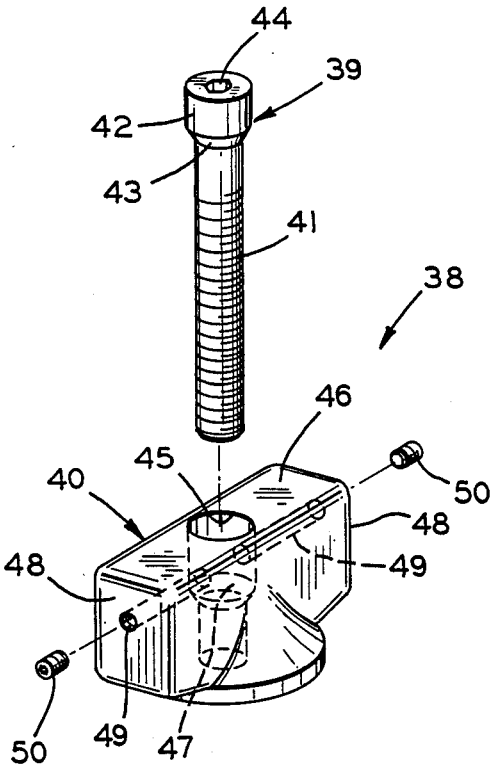
FIG. 7 is a perspective view of a second alternate embodiment of the bolt shown in FIG. 2.

An adjustment bolt 38 according to a second embodiment of the present invention is shown in FIG. 7. The adjustment bolt 38 includes a shank 39 and a separate head 40. The shank 39 includes a portion having threads 41 formed thereon from a lower end to an end connected to an enlarged diameter upper portion 42 by a chamfered portion 43. The upper end of the upper portion 42 has an aperture 44 formed therein which can be configured to engage an Allen wrench.

The head 40 has an aperture 45 centrally formed in a top wall 46 thereof. The aperture 45 extends through the head 40 and is tapered at 47 to a smaller diameter to provide a seat for the chamfered portion 43 of the shank 39. The head 40 has a pair of end walls 48 each of which has a threaded aperture 49 formed therein extending to the aperture 45. Each of the apertures 49 threadably accepts an Allen screw 50 which is then threaded into engagement with the outer surface of the upper portion 42 of the shank 39 to maintain the shank within the aperture 45.

Figure 8:
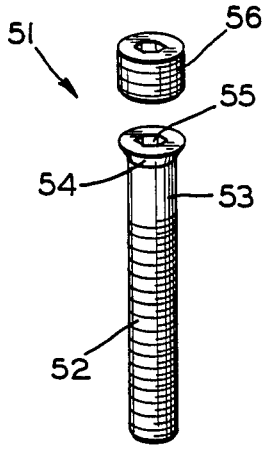
FIG. 8 is a perspective view of an alternate embodiment of the shank of the bolt shown in FIG. 7.

There is shown in FIG. 8 an alternate embodiment of the shank 39 utilized in the adjustment bolt 38 of FIG. 7. A shank 51 includes threads 52 formed from a lower end to an area adjacent an upper end portion 53. The upper end portion 53 is attached to an outwardly tapering portion 54 having an aperture 55 formed in an upper surface thereof suitable for engaging an Allen wrench. The tapered portion 54 cooperates with the tapered portion 47 of the aperture 45 formed in the head 40 of the embodiment shown in FIG. 7. The upper larger diameter portion of the aperture 45 is threaded to accept a plug in the form of an Allen screw 56 which is threaded into contact with the tapering portion 55 to maintain the shank in the aperture 45.

Figure 9:
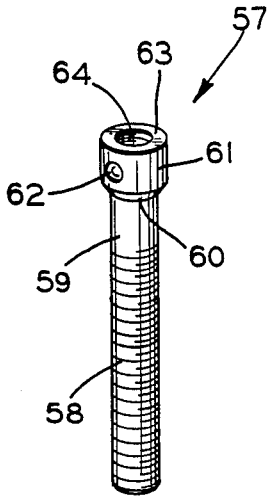
FIG. 9 is a perspective view of a second alternate embodiment of the shank of the bolt shown in FIG. 7.

There is shown in FIG. 9 a second alternate embodiment of a shank suitable for use with the head 40 of FIG. 7. A shank 57 has threads 58 formed thereon from a lower end to a central unthreaded portion 59. The central portion 59 is attached to an outwardly tapered portion 60 which in turn is attached to a larger diameter upper end portion 61. The side wall of the upper end portion 61 can have a depression or aperture 62 formed therein for cooperating with one of the Allen screws 50 shown in FIG. 7. Furthermore, an upper surface 63 of the upper end portion 61 can have a threaded aperture 64 formed therein for retaining a stabilizer such as shown in FIG. 10.

In FIG. 10, the adjustment bolt 33 is adapted to retain a stabilizer 65. The threaded aperture 37 formed in the adjustment bolt 33 retains a threaded end of a shaft 66 of the stabilizer 65. The opposite end of the shaft 66 is attached to an enlarged diameter counterweight 67. The stabilizer 65 is utilized to balance the bow when the drawstring and an arrow are in the desired position for firing. Also, indicia 68 can be formed on the outwardly facing surface of the flange 25 and/or upper taper portion 27 for cooperation with one or more locations on the bow to indicate force settings.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. In a compound archery bow having a central handle portion and upper and lower releasably attachable limbs, a pair of limb adjustment bolts for attaching the limbs to the central handle portion, the bolts each compising:

a shank having external threads formed on at least a portion thereof extending from one end; and a head having a generally rectangular cross section with a longitudinal axis perpendicular to a longitudinal axis of said shank, a front wall and a rear wall extending generally parallel to said longitudinal axis of said head and said longitudinal axis of said shank, a pair of end walls extending between opposite ends of said front and rear walls and generally perpendicular to said longitudinal axis of said head, and a bottom wall and a top wall joining said front wall, said rear wall and said end walls to form said head, a central portion of said head tapering outwardly from said front wall and said rear wall to join a generally circular flange portion, said flange portion having a generally planar surface attached to an opposite end of said shank and having a diameter greater than a distance between said front wall and said rear wall and less than a distance between said end walls.

2. The bolt according to claim 1 wherein said top wall is generally parallel to said planar surface of said flange and a threaded aperture is formed in said top wall and is adapted to retain a weight.

3. The bolt according to claim 1 wherein said outwardly tapered central portion of said head has indicia formed thereon.

4. The bolt according to claim 1 wherein said fange portion of said head has indicia formed thereon.

5. The bolt according to claim 1 wherein said head has an aperture formed thereon from said top wall to said generally planar surface of said flange portion, and said opposite end of said shank is retained in said aperture.

6. The bolt according to claim 5 wherein said aperture has a larger diameter at said top wall, a smaller diameter at said planar surface of said flange portion and a taper between said larger diameter and said smaller diameter and said shank has a chamfered portion for cooperation with said taper.

7. The bolt according to claim 5 including at least one threaded aperture formed in said head extending between an outer surface of said head and said aperture.

8. The bolt according to claim 7 including a screw threadably engaging said threaded aperture and abutting said shank adjacent said opposite end thereof.

9. The bolt according to claim 8 including a depression formed in said shank fior engaging an end of said screw.

10. The bolt according to claim 5 wherein said shank has an aperture formed in said opposite end for receiving a tool.

11. The bolt according to claim 5 wherein said aperture has threads formed therein for threadably engaging a plug.

12. The bolt according to claim 5 wherein said aperture has threads formed therein and including a plug threadably engaging said aperture and having a tool engaging aperture formed therein.

13. A compound archery bow limb adjustment bolt comprising:

a shank having one end threaded and an opposite end;

a generally circular flange having a generally planar surface and being connected to said shank; and a head having a longitudinal axis generally perpendicular to a longitudinal axis of said shank, a front wall and a rear wall extending generally parallel to said longitudinal axis and spaced apart, a pair of end walls extending between opposite ends of said front and rear walls and generally perpendicular to said longitudinal axis of said head, said end walls being spaced apart a distance greater than a diameter of said flange, a top wall and a bottom wall joining said front wall, said rear wall and said end walls to form said head, and said front wall and said rear wall each being connected to said flange by a central outwardly tapering portion thereof, and a central aperture formed therein between a top surface of said top wall and said generally planar surface of said flange, said opposite end of said shank extending into said aperture and including means for retaining said opposite end of said shank in said aperture.

14. The bolt according to claim 13 wherein said means for retaining includes a threaded aperture formed in said head between an outer surface and said central aperture and a screw threadably received in said threaded aperture and abutting said shank adjacent said opposite end.

15. The bolt according to claim 13 wherein said means for retaining includes threads formed on a wall of said aperture and an externally threaded plug engaging said threads in said aperture.

16. A compound archery bow comprising:

a handle portion adapted to be attached to a pair of limbs;

a pair of limbs adapted to be attached to said handle portion; and means including a pair of adjustment bolts for releasably attaching said limbs to said handle portion each of said bolts including a threaded shank connected at one end to a generally circular flange and a head of generally rectangular cross section, said head having spaced apart front and rear walls each having an outwardly tapering central portion attached to said flange, and a pair of end walls attached to opposite ends of said front and rear walls nd spaced apart a distance greater than a diameter of said flange whereby said head can be grasped by a human hand for rotating said bolt with respect to a corresponding one of said limbs to adjust the draw force of the bow.

17. The bow according to claim 16 wherein said head has indicia formed thereon for cooperation with a predetermined location on said corresponding limb to indicate the draw force of the bow.

18. The bow according to claim 16 wherein said opposite end of said shank extends into an aperture formed in said head and including means for retaining said shank in said aperture.

19. The bow according to claim 16 wherein said head of at least one of said bolts has a threaded aperture formed therein for retaining a weight and including a weight having one end thereof engaged in said threaded aperture.

* * * * *